US008491695B2

(12) United States Patent
Saito et al.

(10) Patent No.: US 8,491,695 B2
(45) Date of Patent: Jul. 23, 2013

(54) IRON-BASE SINTERED PART, MANUFACTURING METHOD OF IRON-BASE SINTERED PART AND ACTUATOR

(75) Inventors: Toshiyuki Saito, Toyotake (JP); Takumi Mio, Kariya (JP); Koji Nishi, Anjo (JP); Hajime Fukami, Obu (JP); Kentaro Yamauchi, Lyons (FR); Hiroyuki Yao, Okazaki (JP); Masayuki Yamamoto, Kawagoe (JP); Hideki Yamazaki, Kawagoe (JP)

(73) Assignee: JTEKT Corporation, Osaka-shi (JP)

( * ) Notice: Subject to any disclaimer, the term of this patent is extended or adjusted under 35 U.S.C. 154(b) by 1416 days.

(21) Appl. No.: 12/093,373

(22) PCT Filed: Nov. 15, 2006

(86) PCT No.: PCT/JP2006/323262

§ 371 (c)(1),
(2), (4) Date: May 29, 2008

(87) PCT Pub. No.: WO2007/058370

PCT Pub. Date: May 24, 2007

(65) Prior Publication Data

US 2009/0114046 A1 May 7, 2009

(30) Foreign Application Priority Data

Nov. 16, 2005 (JP) ..... 2005-331781

(51) Int. Cl.
*B22F 3/24* (2006.01)
*F04C 2/30* (2006.01)

(52) U.S. Cl.
USPC ..... 75/246; 75/243; 148/319; 418/82

(58) Field of Classification Search
USPC ..... 74/86; 418/82
See application file for complete search history.

(56) References Cited

U.S. PATENT DOCUMENTS 3,694,114 A * 9/1972 Eickmann ..... 418/82
2003/0033901 A1 * 2/2003 Sugaya et al. ..... 74/567

(Continued)

FOREIGN PATENT DOCUMENTS

EP 1 184 476 3/2002
EP 1 500 449 1/2005

(Continued)

OTHER PUBLICATIONS

Tsutsui, Tadayuki et al., "Yakiire Kotei o Fuyo to shita Fe-Ni-Cu-Mo-C-kei Shoketsu Kokyodo Hagane no Kenkyu", Hitachi Powdered Metals Technical Report, No. 2, pp. 9-13, Figure 9, (2003), (with Partial English translation).

(Continued)

*Primary Examiner* — Roy King
*Assistant Examiner* — Ngoclan T Mai
(74) *Attorney, Agent, or Firm* — Oblon, Spivak, McClelland, Maier & Neustadt, L.L.P.

(57) ABSTRACT

An iron-base sintered part having high density and totally enhanced strength, toughness and abrasion resistance, a manufacturing method of the iron-base sintered part, and an actuator are disclosed. The iron-base sintered part is formed by an iron-nickel-molybdenum-carbon-based sintered alloy, has density of 7.25 g/cm$^3$ or more, and has a carburization quenched structure. A method for manufacturing the iron-base sintered part includes a molding process of charging a raw mixture powder of an iron-nickel-molybdenum-based metal powder and a carbon-based powder into a cavity of a molding die and compressing the raw powder in the cavity to form a consolidation body, a sintering process of sintering the consolidation body at a sintering temperature to form a sintered alloy, and a carburization quenching process of heating the sintered alloy in a carburization atmosphere and quenching the heated alloy.

13 Claims, 7 Drawing Sheets

U.S. PATENT DOCUMENTS

| | | | | |
|---|---|---|---|---|
| 2003/0228949 | A1 | 12/2003 | Okabe et al. | |
| 2006/0029509 | A1 * | 2/2006 | Kurata et al. | 418/61.3 |

FOREIGN PATENT DOCUMENTS

| | | |
|---|---|---|
| GB | 1378844 | 12/1974 |
| JP | 62-188750 | 8/1987 |
| JP | 5 78712 | 3/1993 |
| JP | 7 90513 | 4/1995 |
| JP | 9-118965 | 5/1997 |
| JP | 2001-295915 | 10/2001 |
| JP | 2001-342478 | 12/2001 |
| JP | 2005 146315 | 6/2005 |

OTHER PUBLICATIONS

Endo, Hiroyuki "Shoketsu Kikai Buhin no Gijutsu Doko", Hitachi Powdered Metals Technical Report, No. 1, pp. 2-6, 3.1, (2002), (with Partial English translation).

Reasons for Refusal issued Feb. 23, 2012 in Japanese Patent Application No. 2005-331781 (with Excerpt Translation ).

Supplementary European Search Report issued Apr. 17, 2013 in connection with corresponding European Application No. 06 83 3103, filed Nov. 15, 2006.

* cited by examiner

IRON-BASE SINTERED PART, MANUFACTURING METHOD OF IRON-BASE SINTERED PART AND ACTUATOR

BACKGROUND OF THE INVENTION

1. Field of the Invention

The present invention relates to an iron-base sintered part having an excellent strength, a manufacturing method of the iron-base sintered part and an actuator.

2. Description of the Related Art

Patent Reference 1 discloses a manufacturing method of a sintered part, in which carbon of 0.6 to 0.9 wt % is added in a composite alloy iron base powder, including Ni, Cu, Mo, etc., the powder combined with zinc stearate as a forming lubricant is put into a molding die, a forming body having density of 7.0 to 7.2 g/cm$^3$ is formed, the forming body is sintered at a temperature of 1250 to 1300° C. and then is cooled continuously, thereby generating a martensite-bainite mixed composition. Also, Patent Reference 2 discloses Fe-base alloy having superior abrasion resistance, which is formed by impregnating a carbide precipitated type Fe-base sintered alloy having 5 to 20% porosity with Pb or Pb alloy.

[Patent Reference 1] Japanese Laid-Open Patent Publication No. Hei 5-78712

[Patent Reference 2] Japanese Laid-Open Patent Publication No. Hei 7-90513

The alloy disclosed in the above Patent Reference 1 relates to a method for generating a martensite-bainite mixed composition through continuous cooling, which does not include a carburization quenching process of rapid cooling after carburization. The density of 7.0 to 7.2 g/cm$^3$ is likely high for sintered metal, however it is not always considered high density. This is assumed from the method of charging a metal powder into a cavity of a molding die at a normal temperature or the process of using zinc stearate as a forming lubricant in the technique disclosed in Patent Reference 1. Further, in the process of generating the martensite-bainite mixed composition, residual austenite, which is effective for securing toughness, is not generated. It is also described in paragraph No. 0017 in Patent Reference 1 that residual austenite is not generated. Also, the alloy disclosed in Patent Reference 2 is not subjected to a carburization quenching process.

Recently, a demand for higher performance with respect to an actuator is being increased more and more. Also with respect to an oil pump of a representative example of the actuator, a demand for higher pressure is being recently increased more and more. Because a rotor or a cam ring, which is used in the oil pump, is formed in an iron-base sintered part, strength, toughness and abrasion resistance are secured. However, a demand for higher performance and longer lifespan with respect to the iron-base sintered part is being recently increased more and more.

SUMMARY OF THE INVENTION

Therefore, the present invention has been made in view of the above-mentioned problems, and it is an object of the present invention to provide an iron-base sintered part which has high precision and totally enhanced strength, toughness and abrasion resistance and is effective for higher performance and longer lifespan, a manufacturing method of the iron-base sintered part, and an actuator.

According to a first aspect of the present invention, an iron-base sintered part is formed by an iron-nickel-molybdenum-carbon-based sintered alloy, has density of 7.25 g/cm$^3$ or more, and has a carburization quenched structure. In such a case, since the density of the iron-base sintered part is high, i.e., more than 7.25 g/cm$^3$, strength, toughness and abrasion resistance of the iron-base sintered part can be totally enhanced.

According to a second aspect of the present invention, a method for manufacturing the iron-base sintered part includes a molding process of charging a raw mixture powder of an iron-nickel-molybdenum-based metal powder and a carbon-based powder into a cavity of a molding die and compressing the raw powder in the cavity to form a consolidation body, a sintering process of sintering the consolidation body at a sintering temperature to form a sintered alloy, and a carburization quenching process of heating the sintered alloy in a carburization atmosphere and quenching the heated alloy. Thereby, the iron-base sintered part according to the aforementioned first aspect is formed. Accordingly, the iron-base sintered part having high density can be obtained.

According to a third aspect of the present invention, an actuator includes a housing having an operating chamber, a fixed element mounted in the operating chamber, and a movable element for operating in contact with at least a portion of the fixed element. The movable element and/or the fixed element are formed by the iron-base sintered part according to the aforementioned aspect.

EFFECTS OF THE INVENTION

Since the iron-base sintered part according to the present invention has a highly dense structure, in which density is set to 7.25 g/cm$^3$ or more, strength, toughness and abrasion resistance can be totally increased.

BRIEF DESCRIPTION OF THE DRAWINGS

The above and other objects and features of the present invention will become apparent from the following description of preferred embodiment, given in conjunction with the accompanying drawings, in which.

DETAILED DESCRIPTION OF THE PREFERRED EMBODIMENTS

Figure 1:
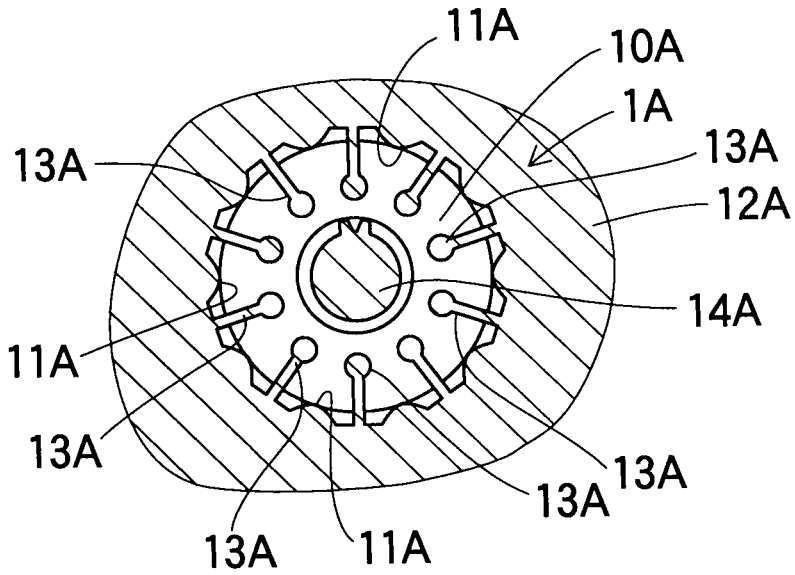
FIG. 1 is a sectional view of essential parts of a molding die for forming a rotor.

Various embodiments of the present invention will now be described in detail with reference to the accompanying drawings.

An iron-base sintered part according to a first aspect of the present invention is formed in an iron-nickel-molybdenum-carbon-base sintered alloy, has density of 7.25 g/cm$^3$ or more, and has a quenched structure which is carburization-quenched. In this case, the present invention can employ the structures having density of 7.25 g/cm$^3$ or more, 7.3 g/cm$^3$ or more, 7.35 g/cm$^3$ or more, and 7.4 g/cm$^3$ or more. A porosity of the iron-base sintered part, on the assumption that the iron-base sintered part is set to 100% with regard to a vol %, may be, for example, 1 to 8%, especially 2 to 7%. A porosity of a common iron-base sintered part is about 10%.

As such, if the iron-base sintered part is highly densified, the iron-base sintered part has a very dense structure, and accordingly strength, toughness and abrasion resistance of the iron-base sintered part are totally enhanced. On the other hand, if the iron-base sintered part is densified excessively, because open pores of the sintered part are reduced, it is difficult for carburizer to penetrate into the sintered part from a surface of the sintered part in a carburization process, and it is difficult to obtain a carburization quenched structure. Thus, an upper limit value of the density of the sintered part, which can be associated with the above-mentioned lower limit value, may be 7.6 g/cm$^3$ or less, 7.5 g/cm$^3$ or less, or 7.4 g/cm$^3$ or less, however the upper limit value is not limited thereto. For example, the density may be in the range of 7.25 to 7.4 g/cm$^3$, or in the range of 7.25 to 7.35 g/cm$^3$.

Since the iron-base sintered part is carburization-quenched, the iron-base sintered part has a quenched structure. The carburization quenching refers to a process of quenching after carburization. The quenched structure may include primarily martensite and residual austenite. For example, with regard to an area ratio, on the assumption that one field of view of a microscope is set to 100%, martensite may be 20 to 80%, 30 to 70% or 40 to 60%, and residual austenite may be 80 to 20%, 70 to 30% or 60 to 40%. When abrasion resistance of the iron-base sintered part is required, residual austenite may be relatively reduced, and martensite may be relatively increased. When fatigue resistance or toughness of the iron-base sintered part is required, residual austenite may be relatively increased, and martensite may be relatively reduced.

With regard to a mass %, on the assumption that the iron-base sintered part is set to 100%, the iron-base sintered part may have a composition comprising nickel of 0.5 to 5.5% (e.g., 2.0 to 5.0%), molybdenum of 0.1 to 1.0% (e.g., 0.3 to 0.8%), copper of 0.5 to 2.0% (e.g., 0.1 to 1.8%, 0.1 to 1.5%), carbon of 0.1 to 0.8% (e.g., 0.1 to 0.5%, or 0.1 to 0.45%), and a remainder containing substantially iron and inevitable impurities. In such a case, since toughness can be easily secured by nickel, the iron-base sintered part can be applied to an element, which requires fatigue resistance, of an actuator (e.g., a rotor member).

Also, with regard to a mass %, on the assumption that the iron-base sintered part is set to 100%, the iron-base sintered part may have a composition comprising nickel of 0.5 to 5.0% (e.g., 2.0 to 5.0%), molybdenum of 0.5 to 1.5% (e.g., 0.5 to 0.8%), copper of 0 to 2.0% (e.g., 0.1 to 2.0%, 0.5 to 2.0%, 1.3 to 1.8%, 1.3 to 1.5%), carbon of 0.1 to 0.8% (e.g., 0.1 to 0.5%, or 0.1 to 0.45%), and a remainder containing substantially iron and inevitable impurities.

Here, in the Fe—Ni—Mo-carbon-base sintered part, which is applied to a movable element such as a rotor or the like and a fixed element such as a cam ring or the like, a mass ratio (Ni content in the movable element such as a rotor or the like/Ni content in the fixed element such as a cam ring or the like) may be in the range of 0.8 to 3, 1.0 to 2.5, 0.8 to 1.3, or 1.0 to 1.3, especially may be 1. In such a case, toughness and fatigue resistance of the movable element such as a rotor or the like are secured, and abrasion resistance of the fixed element such as a cam ring or the like is secured. Since abrasion resistance is secured by molybdenum, the iron-base sintered part can be applied to an element, which requires abrasion resistance, of an actuator (e.g., a cam member). In the above-mentioned composition, nickel is effective for enhancement of toughness.

Figure 7:
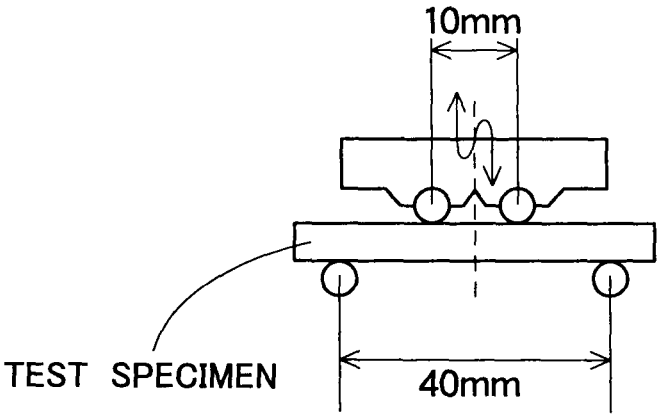
FIG. 7 is a constitutional view showing a test example for measuring fatigue limit.
Figure 9:
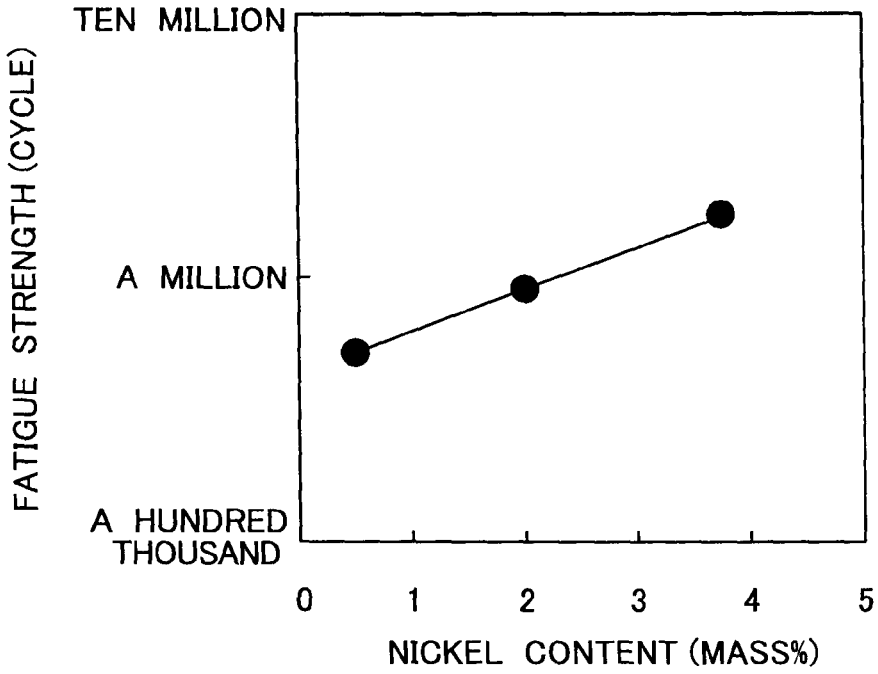
FIG. 9 is a graph showing a relation of nickel content and fatigue strength.

It can be known from results of a test carried out as shown in FIG. 7, which will be described later, that a nickel content and fatigue strength have a relation as follows: as the nickel content is larger, the fatigue strength (number of cycles at which failure occurs when a stress of a predetermined magnitude is repeatedly applied to a material) is improved, as shown by a characteristic line in FIG. 9. In a case where the present invention is applied to a cam ring of a vane type oil pump, which will be described later, it is known from results of an operation durability test for the oil pump that chipping (fatigue abrasion) possibly occurs on a cam surface of a test specimen, in which a nickel content is around 2%. Thus, it is preferred that a nickel content is set to be 3% or more, so as to prevent the occurrence of chipping. However, because hardness is deteriorated as the nickel content is larger, the excessive addition of nickel is not preferable.

Figure 10:
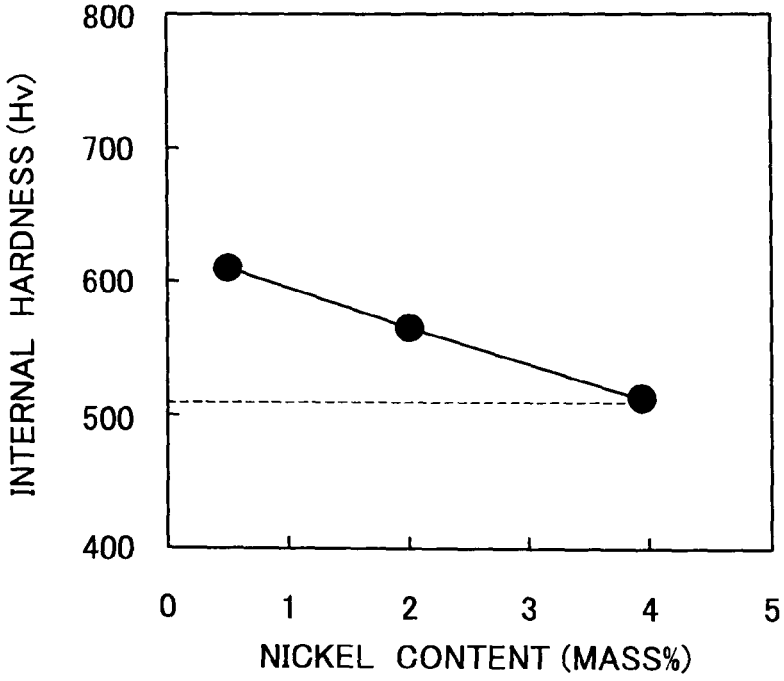
FIG. 10 is a graph showing a relation of nickel content and internal hardness.

FIG. 10 shows a relation of the nickel content and internal hardness (hardness at a depth of 1 mm from a surface under a load of 2N) of a cam ring. Referring to a characteristic line in FIG. 10, it is preferable to set the nickel content to be 4% or less, so as to secure internal hardness (Hv) of about 450 to 500 refer to the Third Embodiment and FIG. 8, which will be described later capable of obtaining suitable surface hardness with excellent toughness. Carbon is also effective for getting the quenched structure.

A method for manufacturing an iron-base sintered part according to a second aspect of the present invention comprises sequentially: a molding process of charging a raw mixture powder of an iron-nickel-molybdenum-based metal powder and a carbon-based powder into a cavity of a molding die, and compressing the raw powder in the cavity to form a consolidation body; a sintering process of sintering the consolidation body at a sintering temperature to form a sintered alloy; and a carburization quenching process of heating the sintered alloy in a carburization atmosphere and quenching the heated alloy. Through the above method, the sintered part according to the above-mentioned aspect is formed. A gas carburization atmosphere can serve as an example of the carburization atmosphere.

As described above, if the iron-base sintered part is highly densified, it is difficult for carburizer to penetrate into the sintered part from the surface of the sintered part. And, it is preferable to mix the carbon-based powder (e.g., graphite powder) with the metal powder in advance. With regard to a mass %, on the assumption that the metal powder is set to 100%, the carbon-based powder can be added by 0.1 to 0.5%. Alternatively, the carbon-based powder can be added by 0.1 to 0.4% or 0.1 to 0.3%. To add the carbon-based powder by 0.3% when the metal powder is set to 100% means that the total becomes 100.3%.

Prior to the molding process, a process of coating a long-chain fatty acid-based lubricant onto a molding surface of the cavity of the molding die, and/or a process of adding a long-chain fatty acid-based lubricant in the raw powder may be carried out. In such a case, a charging density of the metal powder can be increased. Accordingly, it is preferable to use the raw powder including a long-chain fatty acid-based lubricant. Long-chain fatty acid metal salt can be employed as the long-chain fatty acid-based lubricant. In such a case, the long-chain fatty acid metal salt can be configured as at least one selected from the group consisting of lithium salt, calcium salt, and zinc salt. Specifically, it is preferable to use at least one selected from the group consisting of lithium stearate and calcium stearate as a base material.

When using a release agent liquid, in which a long-chain fatty acid-based lubricant is dispersed or dissolved in liquid such as water or the like, the release agent liquid can be attached evenly by a spraying method or the like. Therefore, it is preferable to use the release agent liquid including a long-chain fatty acid-based lubricant. With regard to a mass %, on the assumption that the whole release agent liquid is set to 100%, the amount of the long-chain fatty acid-based lubricant may be in the range of 0.1 to 10% or 0.2 to 5%. In such a case, if spraying the release agent liquid onto the molding surface of the cavity of the heated molding die, because the release agent liquid is rapidly heated and evaporated, the long-chain fatty acid-based lubricant can be coated evenly onto the molding surface of the cavity of the molding die. Therefore, it is preferable to heat the molding surface of the cavity of the molding die, for example, to 100° C. or more prior to the coating process.

In the molding process, it is preferred that the molding surface of the cavity of the molding die and/or the raw powder is previously heated to 100 to 250° C. or 100 to 220° C. In such a case, a charging density of the raw powder in the cavity of the molding die can be increased, and the high densification of the sintered part can be promoted.

An actuator according to a third aspect of the present invention comprises a housing having an operating chamber, a fixed element mounted in the operating chamber, and a movable element to be driven by a driving source. The movable element and/or the fixed element are formed by the above-described iron-base sintered part. In such a case, the fixed element is an element fixed in the operating chamber of the housing, which may include, for example, a cam having a ring-shaped cam surface. The movable element is an element capable of being moved in the operating chamber of the housing, which may include, for example, a rotor surrounded by the cam surface with a gap therebetween and having a recess on an outer peripheral portion thereof, and a vane forward/backward movably fitted into the recess of the rotor and having a front end portion for sliding on the cam surface of the cam. Such a movable element can be applied to a pump or a gear mechanism. A vane type pump or a gear pump may be employed as a pump. Also, the movable element may be configured in such a manner to be moved in contact with the fixed element.

(First Embodiment)

Hereinafter, the first embodiment of the present invention will be explained in detail with reference to the drawings. First, a method for manufacturing the rotor will be explained. As a metal powder for forming the rotor, an iron-base metal powder, which contains nickel of 4%, molybdenum of 0.50% and copper of 1.50%, with regard to a mass %, was prepared. Because carbon is not substantially included in the above metal powder, the hardness of the powder particle becomes low, and molybdenum is reduced and nickel is increased so as to enhance fatigue resistance of the sintered part. As such, in the metal powder for forming the rotor, as the element requiring the fatigue resistance, a ratio of the nickel quantity to the molybdenum quantity is set to be 8 (nickel quantity/molybdenum quantity=4.0%/0.50%=8). Accordingly, the amount of residual austenite suitable for the rotor of the element requiring the abrasion resistance can be secured, while martensite is generated. The raw mixture powder of the above-mentioned metal powder and a graphite powder (carbon-based powder) was formed. In this case, with regard to a mass %, on the assumption that the metal powder is set to 100%, the graphite powder is added by 0.3%.

FIG. 1 shows a first molding die 1A to form a rotor. The first molding die 1A includes a first molding die body 12A having a cavity molding surface 11A forming a cavity 10A, a plurality of protruding portions 13A protruding toward a center of the cavity 10A with intervals therebetween along a circumferential direction to form recesses, and a central die part 14A disposed in the center of the cavity 10A. Since the plurality of protruding portions 13A are provided radially around the central die part 14A, the cavity 10A of the first molding die 1A is formed in a non-circular and irregular shape.

According to this embodiment, prior to the molding process, a applying process of evenly coating a release agent, formed by dissolving lithium stearate (long-chain fatty acid-based lubricant) in water, on the cavity molding surface 11A of the first molding die 1A by use of a spray was carried out. Lithium stearate has a melting point of about 225° C., and an average particle size of 18 to 22 μm. The release agent consists of lithium stearate of 0.1 to 5%, especially 4%, with regard to a mass %, and a remainder containing substantially water. If a high pressure is applied to lithium stearate in a warm region, a film having a high lubricating performance is formed. Accordingly, even when a charging density of the raw powder becomes high or the cavity 10A of the first molding die 1A is formed in a non-circular and irregular shape, releasing of the consolidation body from the cavity molding surface 11A can be enhanced. Also, when lithium stearate is used as the release agent, since lithium stearate has a good lubricating performance in a warm region, lithium stearate is effective for the increase in the charging density of the raw powder and the high densification, even when the cavity 10A or 10B has an irregular or non-circular shape. In order to increase the charging density of the raw powder, lithium stearate is added also in the raw powder (adding amount: when the raw powder is set to 100%, additionally 0.2 mass %). Lithium stearate is supposed to form iron stearate by mechanochemical reaction at a high temperature and a high pressure, enhance a lubricating performance, and enhance releasing of the consolidation body from the cavity molding surface 11A.

After the release agent was coated onto the cavity molding surface 11A of the first molding die 1A, the raw powder was charged into the cavity 10A of the first molding die 1A. At this time, the first molding die 1A was previously heated to 150 to 200° C., and also the raw powder was previously heated to 150 to 200° C. The raw powder is warm charged into the cavity 10A. As such, if the raw powder is warm charged, the charging density of the raw powder can be increased, and the high densification can be promoted. Then, a consolidation body was formed by compressing the raw powder in the cavity 10A of the first molding die 1A at a predetermined pressing force (7 tonf/cm$^2$) by use of a press body (molding process). Thereafter, the consolidation body was drawn out of the cavity 10A of the first molding die 1A, and was heated at a sintering temperature (1240° C.) for 60 minutes, thereby forming a sintered alloy (sintering process). Then, the sintered alloy was kept at a normal temperature.

The sintered alloy was gas carburized by being heated at 920° C. for 260 minutes in a gas carburization atmosphere (carbon potential C.P: 1.1%). Thereafter, the sintered alloy was quenched by being inputted into an oil (60° C.) from the above temperature, thereby forming the sintered alloy (carburization quenching process). Thereafter, the sintered alloy was tempered by being heated at a tempering temperature (180° C.) for a predetermined time (70 minutes). The density of the sintered alloy after the tempering process was 7.4 g/cm$^3$. The density was measured based on the JIS Z2505 (test method for sintered density of sintered metal material). The quenched structure included primarily martensite and residual austenite.

Figure 11:
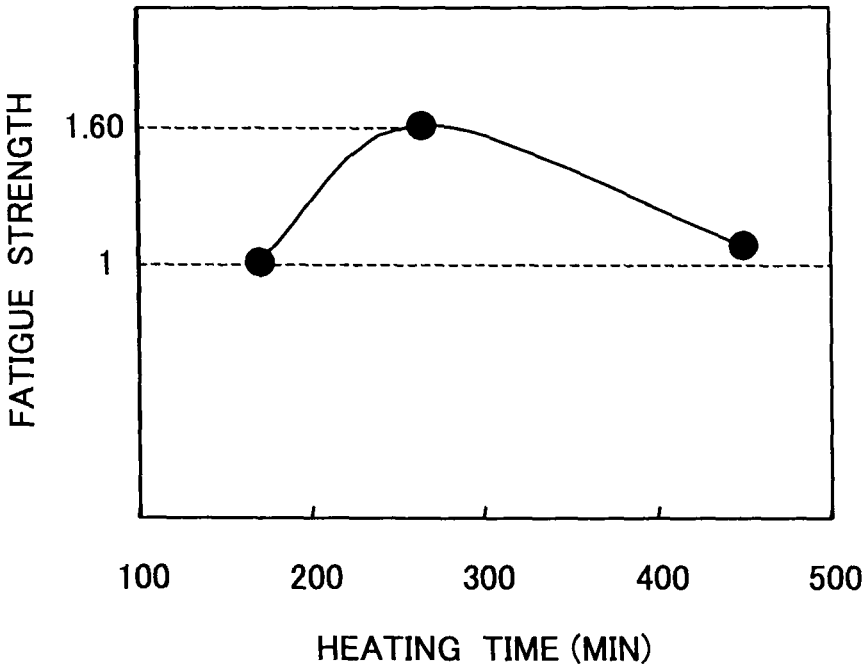
FIG. 11 is a graph showing a relation of a heating time in gas carburization and fatigue strength (relative value).

A relation of a heating time for gas carburization and a fatigue strength (relative value) is known from results of a test carried out as shown in FIG. 7, which will be described later, such that the fatigue strength (stress level under which a material will fail after it has experienced the stress for a specified number of cycles) shows the maximum value when the heating time is around 260 minutes, as shown by a characteristic line in FIG. 11. Referring to FIG. 11, the heating time for gas carburization is preferably set to 200 to 400 minutes or 240 to 350 minutes.

In a case of a rotor, with regard to an area ratio, on the assumption that one field of view of a microscope is set to 100%, martensite is 70 to 60%, and residual austenite is 30 to 40%. And, the residual austenite quantity for enhancing toughness and fatigue resistance is relatively secured. In a case of a cam ring, with regard to an area ratio, on the assumption that one field of view of a microscope is set to 100%, if martensite is 75 to 65% and residual austenite is 25 to 35%, the martensite quantity is relatively secured. It can be set that the rotor requiring fatigue resistance and toughness has the higher area ratio of residual austenite than the cam ring requiring abrasion resistance at the surface.

Figure 2:
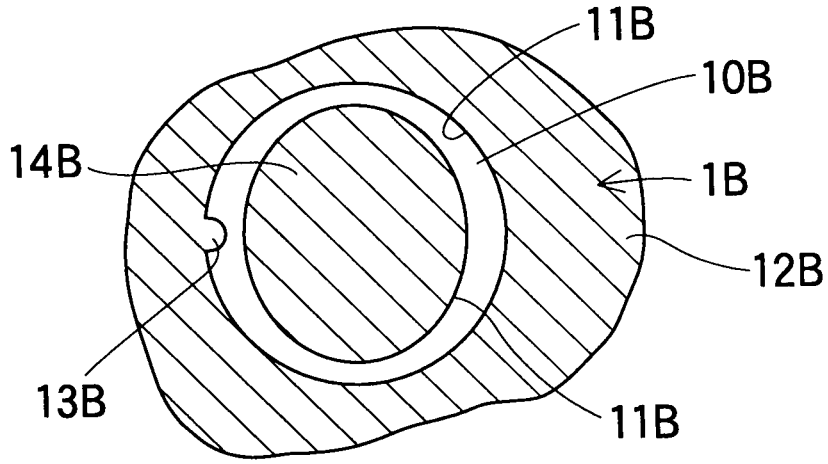
FIG. 2 is a sectional view of essential parts of a molding die for forming a cam ring.

Next, a method for manufacturing the cam ring will be explained. Since the manufacturing method of the cam ring is basically the same as the manufacturing method of the rotor, characteristic parts over the rotor will be primarily explained. FIG. 2 shows a second molding die 1B for forming the cam ring. The second molding die 1B includes a second molding die body 12B having a cavity molding surface 11B forming a cavity 10B, a protruding portion 13B formed at the second molding die body 12B, and a central die part 14B opposing the cavity molding surface 11B. The cavity 10B is formed in a non-circular and irregular shape, with respect to a center thereof.

First, as a metal powder for forming the cam ring, similarly to the rotor, an iron-base metal powder, which contains nickel of about 4% and molybdenum of 0.50%, with regard to a mass %, was prepared. Carbon is not substantially included in the above metal powder. In a case where abrasion resistance of the sintered part is intended to be more enhanced, molybdenum may be increased, while nickel may be reduced. As such, in the metal powder for forming the cam ring, as the element requiring the abrasion resistance, in order to secure the abrasion resistance, similarly to the rotor, a ratio of the nickel quantity to the molybdenum quantity is set to be 8 (nickel quantity/molybdenum quantity=4.0%/0.50%=8). Thereby, the fatigue resistance and the abrasion resistance can be totally and excellently secured.

A raw powder was formed by evenly mixing the metal powder for the cam ring with a graphite powder (carbon-based powder). In this case, with regard to a mass %, on the assumption that the metal powder is set to 100%, the graphite powder was added by 0.3%. Similarly to the rotor, a consolidation body forming process, a sintering process, a carburization quenching process, and a tempering process were carried out sequentially. Basically similar to the rotor, the quenched structure of the cam ring includes primarily martensite and residual austenite. With regard to an area ratio, on the assumption that one field of view of a microscope is set to 100%, in order to enhance the abrasion resistance, martensite is 75 to 65%, which is a little larger than that of the rotor, and residual austenite is 25 to 35% (remainder). Martensite may be 77 to 67%. Also, bainite is not substantially generated.

Figure 12:
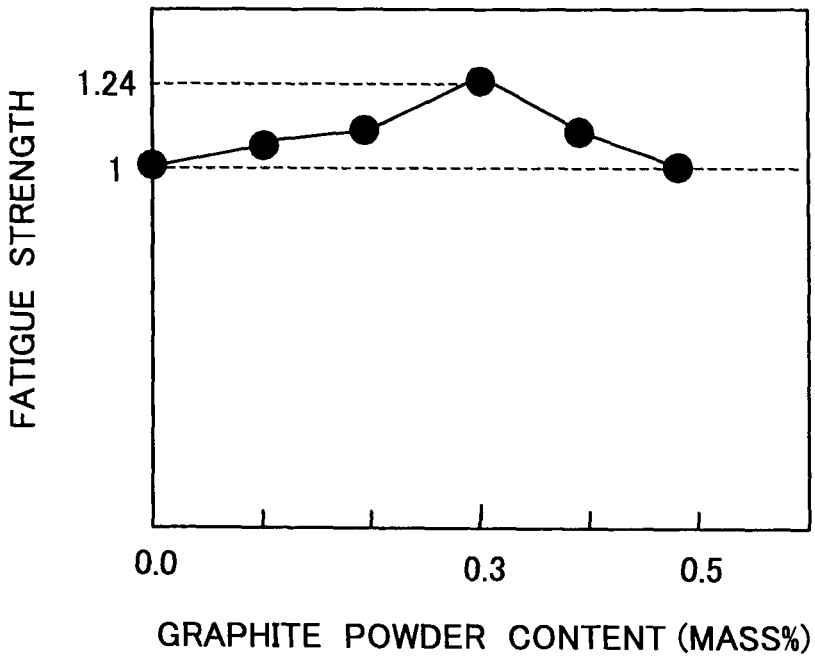
FIG. 12 is a graph showing a relation of graphite powder content and fatigue strength (relative value).

A relation of a mixing amount (mass %) of the graphite powder and a fatigue strength is known from results of a test carried out as shown in FIG. 7, which will be described later, such that the fatigue strength (stress level under which a material will fail after it has experienced the stress for a specified number of cycles) shows the maximum value when the graphite is around 0.3%, as shown by a characteristic line in FIG. 12.

According to this embodiment, with regard to a mass %, on the assumption that the iron-base sintered part forming the rotor is set to 100%, the iron-base sintered part has a composition consisting of nickel of about 4%, molybdenum of about 0.50%, copper of about 1.50%, carbon of about 0.2 to 1.0% (internal~surface concentration), and a remainder containing substantially iron and inevitable impurities.

With regard to a mass %, on the assumption that the iron-base sintered part forming the cam ring is set to 100%, the iron-base sintered part has a composition consisting of nickel of about 4%, molybdenum of about 0.50%, carbon of about 0.2 to 1.0% (internal~surface concentration), and a remainder containing substantially iron and inevitable impurities. According to this embodiment, a Ni content ratio (Ni content in the rotor/Ni content in the cam ring=4%/4%) is 1. A Mo content ratio (Mo content in the cam ring/Mo content in the rotor=0.5%/0.5%) is 1.

According to this embodiment, in the process of charging the raw powder into the cavities 10A and 10B of the molding dies 1A and 1B, because the molding dies 1A and 1B and the raw powder are heated to be a warm state, the charging density of the raw powder and the density of the consolidation body can be increased. When the molding dies 1A and 1B and the raw powder are heated to be a warm state, it is preferable to restrict excessive decomposition of the lubricant. In this regard, according to this embodiment, since the warm charging is performed and also lithium stearate capable of easily working as a lubricant in the warm region is used, high lubricating performance at the cavity molding surfaces 11A and 11B and the raw powder can be obtained, while the raw powder is warm charged into the cavities 10A and 10B of the molding dies 1A and 1B. Accordingly, the sintered parts forming the rotor and the cam ring are highly densified, and have a very dense structure.

As such, according to this embodiment, since the rotor and the cam ring are highly densified and have a very dense structure, strength, abrasion resistance and fatigue strength are totally and excellently secured. However, as described above, if the sintered part is excessively highly densified and has an excessive dense structure, because open pores of the sintered part are reduced, it is difficult for the carburizer to penetrate into the sintered part in the carburization process, and thus the carburizing amount tends to be insufficient. In this regard, since the present invention is configured such that the raw mixture powder of the metal powder and the graphite powder of the predetermined amount is charged into the cavities 10A and 10B of the molding dies 1A and 1B, the carbon quantity necessary to secure the quenched structure in the sintered part is secured. At this time, instead of mixing the graphite powder with the metal powder, a method of previously increasing the carbon quantity contained in the metal powder can also be considered. However, in this case, because the particles of the metal powder become hard, when the metal powder is charged into the cavities 10A and 10B, the charging density is decreased, and thus there is a limitation in enhancing the strength. In this regard, in this embodiment, the carbon content in the metal powder is set to substantially zero to decrease hardness of the particles of the metal powder, and the necessary carbon quantity is supplemented by addition of the graphite powder, thereby increasing the charging density of the raw powder.

(Actuator)

Figure 3:
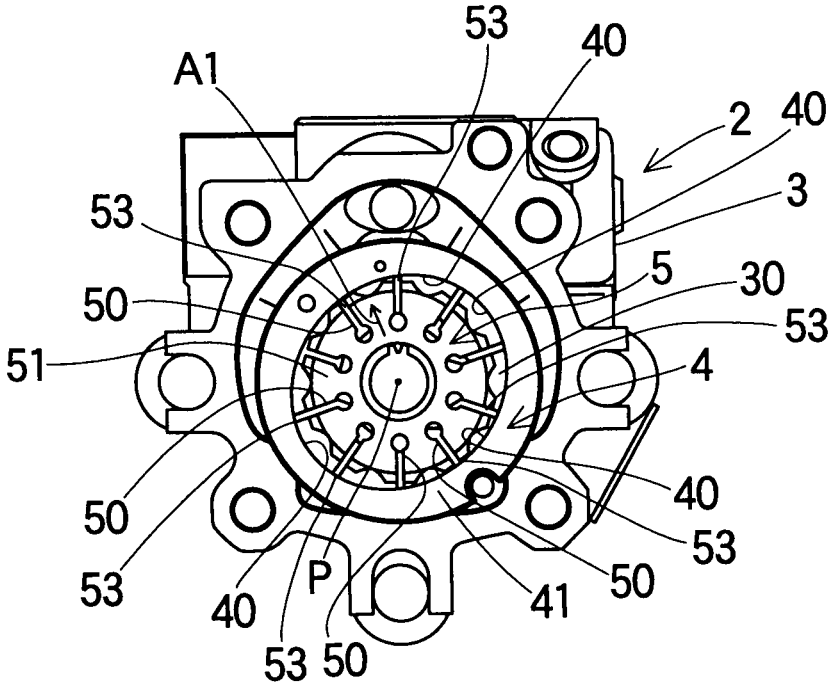
FIG. 3 is a constitutional view of a vane type oil pump.

FIG. 3 shows an example of applying the present invention to a vane type oil pump 2 as an actuator. As shown in FIG. 3, the oil pump 2 includes a housing 3 having an operating chamber 30, a fixed element 4 mounted in the operating chamber 30, and a movable element 5 to be moved in contact with at least a portion of the fixed element 4. The fixed element 4 includes a cam ring 41 having a ring-shaped cam surface 40, which extends round a center line P. The movable element 5 includes a rotor 51 surrounded by the cam surface 40 with a gap therebetween and having a plurality of recesses 50 on an outer peripheral portion thereof, and a plurality of vanes 53 (material: SKH51) forward/backward movably fitted into the respective recesses 50 of the rotor 51 and having front end portions interacting contactingly with the cam surface 40 of the cam ring 41. The rotor 51 is connected to a driving source so as to be driven. If the rotor 51 is rotated round the center line P together with the vanes 53 by power from the driving source, the front end portions of the vanes 53 interact contactingly with the cam surface 40 of the cam ring 41. At this time, the vanes 53 move outwardly from the recesses 50 in a centrifugal direction (direction of an arrow A1) by a centrifugal force, or the vanes 53 are pressed by the cam surface 40 and move into the recesses 50 in a centripetal direction. As a result, the capacity of the chamber sectioned by the adjacent vanes 53 is changed. At this time, fluid (oil) is sucked into the operating chamber from a fluid suction port of a low pressure. Also, the fluid (oil) in the operating chamber 30 is discharged from a fluid discharge port of a high pressure. Since the vanes 53 interact contactingly with the cam surface 40 of the cam ring 41, the cam ring 41 generally requires abrasion resistance besides the strength. The rotor 51 for operating the vanes 53 generally requires fatigue resistance besides the strength.

The density of the rotor 51 is 7.4 g/cm$^3$, and the density of the cam ring 41 is 7.4 g/cm$^3$, identically to the rotor 51. As such, since the rotor 51 and the cam ring 41 are highly densified and have a very dense structure, strength, abrasion resistance and fatigue strength are totally secured. Also, if the molybdenum quantity in the cam ring 41 is set larger than that in the rotor 51, the cam ring 41 secures fatigue resistance and toughness, and further can enhance surface hardness and abrasion resistance at the surface. Also, if the nickel quantity in the rotor 51 is set larger than that in the cam ring 41, fatigue resistance and toughness of the rotor 51 can be enhanced.

(Second Embodiment)

A second embodiment has basically the same constitution and operational effects as the first embodiment. FIGS. 1 to 3 can be applied correspondingly to the second embodiment. According to this embodiment, both the rotor 51 and the cam ring 41 have density of 7.25 g/cm$^3$ or more. Accordingly, the rotor 51 and the cam ring 41 are highly densified and have a very dense structure, and strength, abrasion resistance and fatigue strength are totally secured. Also while the rotor 51 and the cam ring 41 are highly densified, the rotor 51 and the cam ring 41 have a relation such that the density of the rotor 51 is larger than the density of the cam ring 41 (density of the rotor 51>density of the cam ring 41). Thus, since the carburizer easily penetrates into the cam ring 41 in the carburization process, strength and fatigue strength of the cam ring 41 can be secured, and further the carburizing amount in the vicinity of the cam surface 40, which is the surface of the cam ring 41, can be increased, thereby increasing the area ratio of martensite.

(Third Embodiment)

Figure 4:
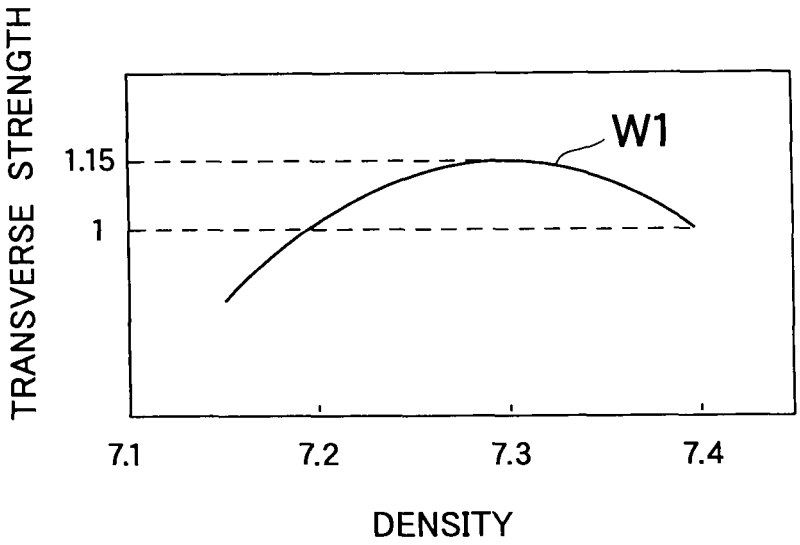
FIG. 4 is a graph showing a relation of density and transverse strength (relative value).
Figure 5:
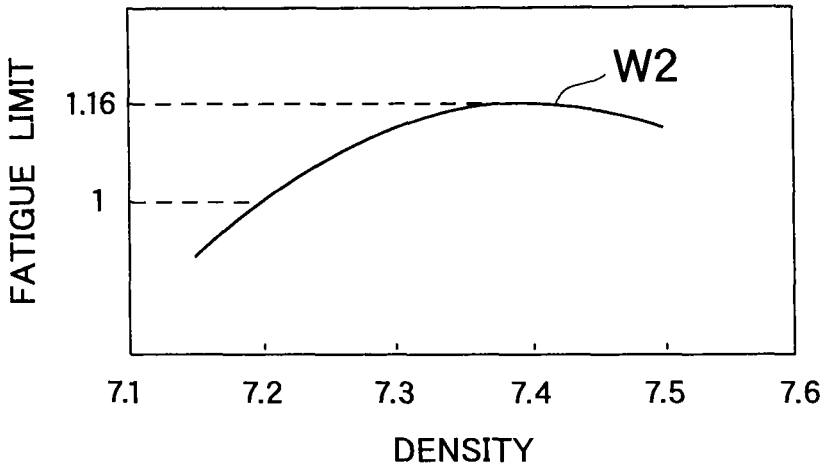
FIG. 5 is a graph showing a relation of density and fatigue limit (relative value).

A test example will be explained. A test specimen (size: 55 mm×10 mm×5 mm, basic composition: Ni: 4%, Cu: 1.50%, Mo: 0.50%, remainder: Fe) having a composition corresponding to the rotor 51 according to the aforementioned embodiment was manufactured, and a test was carried out with respect to a relation of transverse strength, fatigue strength (stress level at which failure does not occur even after the stress of a predetermined magnitude is applied for ten million cycles or more) and density. FIG. 4 shows a relation of the density (g/cm$^3$) and the transverse strength (relative value) of the test specimen. FIG. 5 shows a relation of the density (g/cm$^3$) and the fatigue limit (relative value) of the test specimen. As shown by a characteristic line W1 in FIG. 4, the transverse strength shows the maximum value when the density is around 7.3. As shown by a characteristic line W2 in FIG. 5, the fatigue strength shows the maximum value when the density is around 7.4. As such, as the density of the sintered alloy of the test specimen is increased, the transverse strength and the fatigue strength were increased. However, it was confirmed that if the density of the test specimen is excessively high, the transverse strength and the fatigue strength tended to be decreased. It is supposed that if the density of the sintered alloy of the test specimen is excessively high, the transverse strength and the fatigue strength are decreased, because it is difficult for the carburizer to penetrate into the sintered alloy and thus it is difficult to obtain the desirable carburization quenched structure. Thus, when considering the security of the transverse strength (refer to FIG. 4), the density of the sintered alloy is about 7.250 to 7.40 g/cm$^3$, preferably 7.25 to 7.335 g/cm$^3$ or 7.25 to 7.33 g/cm$^3$. Also, when considering the security of the fatigue strength (refer to FIG. 5), the density of the sintered alloy is about 7.30 to 7.50 g/cm$^3$, preferably 7.35 to 7.48 g/cm$^3$.

Figure 6:
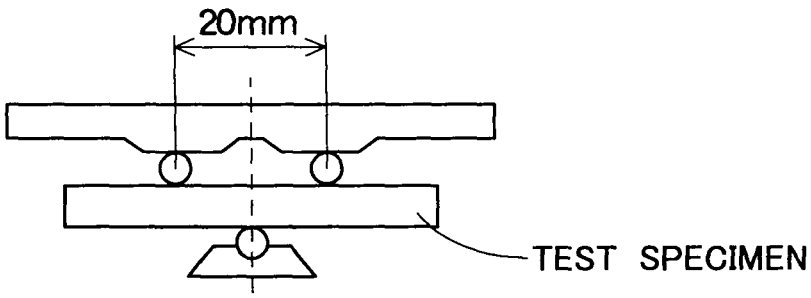
FIG. 6 is a constitutional view showing a test example for measuring transverse strength.

FIG. 6 shows a test example with respect to the transverse strength (three-point bending). FIG. 7 shows a test example with respect to the fatigue strength (four-point bending).

Figure 8:
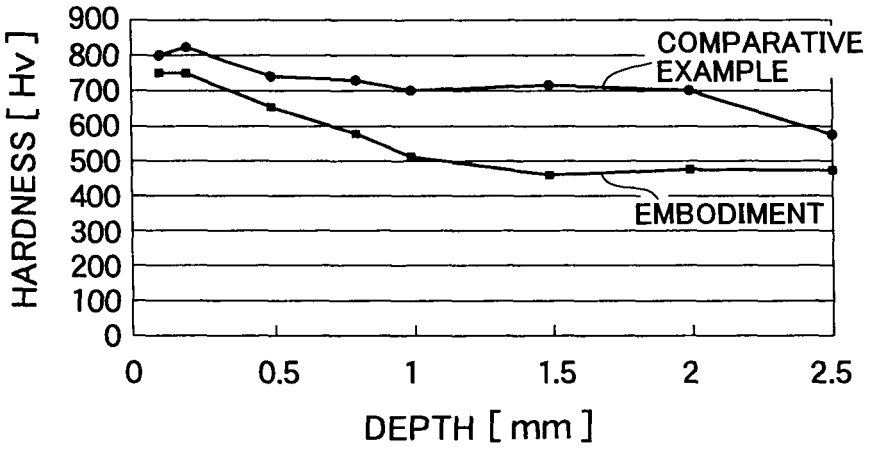
FIG. 8 is a graph showing a relation of a depth and hardness.

Also, with respect to the cam ring 41 (size: maximum outer diameter: 52.5 mm, maximum inner diameter: 45.0 mm, basic composition: Ni: 4%, Mo: 0.50%, remainder: Fe) according to the aforementioned embodiment, a relation of a depth from the surface of the cam ring and hardness was measured. FIG. 8 shows a relation of a depth from the surface of the cam ring and hardness (load of 2N). The same measurement was performed with respect to the cam ring 41 of a comparative example. The comparative example was manufactured under basically the same conditions as the embodiment, in which a consolidation body made of the same metal powder as the embodiment was sintered, carburization quenched, and tempered, and a graphite powder was not used. The sintered density of the cam ring of the comparative example is 7.2 g/cm$^3$, whereas the sintered density of the cam ring of the embodiment is 7.4 g/cm$^3$, that is, the cam ring of the embodiment is highly densified and has a very dense structure, and accordingly the embodiment can totally enhance strength, toughness and abrasion resistance.

As shown in FIG. 8, the hardness of the cam ring according to the comparative example is about Hv800 when the depth is around 0.1 to 0.2 mm. Even though the depth is greater, the hardness was about Hv700. With respect to the cam ring according to the embodiment, when the depth is around 0.1 to 0.2 mm, the embodiment has hardness (Hv700 to 800) which is almost equivalent to the hardness of the comparative example, that is, the abrasion resistance at the surface is secured. Further, as shown in FIG. 8, when the depth is around 1 mm, the embodiment has hardness of about Hv450 to 500, which is much lower than the hardness of the comparative example, that is, toughness is secured. As described above, in the embodiment, since the high densification of the sintered alloy is promoted, even though it is difficult for the carburizer to penetrate into the sintered alloy, the surface hardness is kept high, and accordingly the abrasion resistance at the surface can be secured. Moreover, the carburizer can be restricted from penetrating into the sintered alloy, and accordingly the increase in the internal hardness of the sintered alloy can be restricted, thereby easily securing toughness.

(Other Embodiments)

According to the aforementioned embodiment, the sintered alloy is heated in a gas carburization atmosphere, and then is put into oil (60° C.) to be quenched, however the manufacturing method is not limited thereto. The sintered alloy may be quenched by water cooling. From the above description, the following technical ideas also can be understood.

(Added Claim 1) An iron-base sintered part, a manufacturing method of the iron-base sintered part and an actuator according to each of claims, wherein a metal powder or an iron-base sintered part has a mass ratio of nickel to molybdenum (nickel quantity/molybdenum quantity) which is set to 9 to 6, or 8 to 6. In such a case, with regard to the mass ratio, for example, the amount of nickel may be 4 to 3%, and the amount of molybdenum may be 0.5%.

(Added Claim 2) An iron-base sintered part formed by sintering a consolidation body made of a raw mixture powder of an iron-nickel-molybdenum-based metal powder and a carbon-based powder and carburization quenching the sintered consolidation body, and having an iron-nickel-molybdenum-carbon-based carburization quenched structure having density of 7.25 g/cm$^3$ or more.

Industrial Applicability

The present invention can be applied to an iron-base sintered part, a movable element (rotor or the like) and a fixed element (cam ring or the like) formed by the sintered part.

While the invention has been shown and described with respect to the preferred embodiments, it will be understood by those skilled in the art that various changes and modification may be made without departing from the spirit and scope of the invention as defined in the following claims.

The invention claimed is:

1. An actuator comprising:

a housing having an operating chamber;

a fixed element mounted in the operating chamber; and a movable element to be driven by a driving source, wherein the fixed element is a cam having a ring-shaped cam surface, wherein the cam is formed by a first iron-base sintered part comprising a carburization quenched structure formed by an iron-nickel-molybdenum-carbon-based sintered alloy, the carburization quenched structure having a density of 7.25 g/cm$^3$ or more, and wherein the movable element includes a rotor surrounded by the cam surface with a gap therebetween and having a recess on an outer peripheral portion thereof, and a vane forward/backward movably fitted into the recess of the rotor and having a front end portion for sliding on the cam surface of the cam.

2. The actuator according to claim 1, wherein the rotor is formed by a second iron-base sintered part having a carburization quenched structure formed by an iron-nickel-molybdenum-carbon-based sintered alloy, the carburization quenched structure having density of 7.25 g/cm$^3$ or more.

3. The actuator according to claim 1, wherein the first iron-base sintered part is set to 100% with regard to mass %, the first iron-base sintered part consists essentially of nickel of 0.5 to 5.5%, molybdenum of 0.1 to 1.0%, copper of 0.5 to 2.0%, carbon of 0.1 to 0.8%, and a remainder containing substantially iron and inevitable impurities.

4. The actuator according to claim 3, wherein the amount of nickel is 3-4 mass %.

5. The actuator according to claim 1, wherein the first iron-base sintered part is set to 100% with regard to a mass%, the iron-base sintered part comprising 0.5 to 5.0% nickel, 0.5 to 1.5% molybdenum, 0 to 2.0% copper, 0.1 to 0.8% carbon, and a remainder containing substantially iron and inevitable impurities.

6. The actuator according to claim 5, wherein the amount of nickel is 3-5 mass %.

7. An actuator, comprising:

a housing having an operating chamber;

a fixed element mounted in the operating chamber; and a movable element to be driven by a driving source, wherein the fixed element is a first iron-base sintered part having a carburization quenched structure formed by an iron-nickel-molybdenum-carbon-based sintered alloy, and having a density of 7.25 g/cm$^3$ or more.

8. The actuator according to claim 7, wherein the fixed element is a cam having a ring-shaped cam surface.

9. The actuator according to claim 8, wherein the movable element includes a rotor surrounded by the cam surface with a gap therebetween and having a recess on an outer peripheral portion thereof, and a vane forward/backward movably fitted into the recess of the rotor and having a front end portion for sliding on the cam surface of the cam.

10. The actuator according to claim 7, wherein the first iron-base sintered part is set to 100% with regard to mass %, the first iron-base sintered part consists essentially of 0.5 to 5.5% nickel, 0.1 to 1.0% molybdenum, 0.5 to 2.0% copper, 0.1 to 0.8% carbon, and a remainder containing substantially iron and inevitable impurities.

11. The actuator according to claim 10, wherein the amount of nickel is 3-4 mass %.

12. The actuator according to claim 7, wherein the first iron-base sintered part is set to 100% with regard to mass %, the iron-base sintered part comprising 0.5to 5.0% nickel, 0.5 to 1.5% molybdenum, 0 to 2.0% copper, 0.1 to 0.8% carbon, and a remainder containing substantially iron and inevitable impurities.

13. The actuator according to claim 12, wherein the amount of nickel is 3-5 mass %.

* * * * *